US008974313B2

(12) United States Patent
Ishii et al.

(10) Patent No.: US 8,974,313 B2
(45) Date of Patent: Mar. 10, 2015

(54) METHOD AND APPARATUS FOR DETERMINING AN ANGLE OF ATTACK FROM MULTIPLE BALL HITTING

(75) Inventors: Hideyuki Ishii, Portland, OR (US); Arthur P. Molinari, Beaverton, OR (US); Nicholas A. Leech, Aloha, OR (US); Yutaka Kabeshita, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 6 days.

(21) Appl. No.: 13/307,789

(22) Filed: Nov. 30, 2011

(65) Prior Publication Data

US 2013/0137528 A1 May 30, 2013

(51) Int. Cl.

| | |
|---|---|
| ***A63B 69/36*** | (2006.01) |
| ***A63B 24/00*** | (2006.01) |
| *A63B 71/06* | (2006.01) |

(52) U.S. Cl.

CPC ..... *A63B 69/36* (2013.01); *A63B 24/00* (2013.01); *A63B 24/0003* (2013.01); *A63B 2071/0625* (2013.01); *A63B 2220/05* (2013.01); *A63B 2220/16* (2013.01); *A63B 2220/806* (2013.01); *A63B 2225/50* (2013.01)

USPC ..... 473/150; 473/198; 473/223

(58) Field of Classification Search

CPC ..... A53B 24/0003

USPC ..... 473/199, 221, 223; 702/145

See application file for complete search history.

(56) References Cited

U.S. PATENT DOCUMENTS

| | | | |
|---|---|---|---|
| 4,063,259 | A | 12/1977 | Lynch et al. |
| 4,136,387 | A | 1/1979 | Sullivan et al. |
| 4,375,887 | A | 3/1983 | Lynch et al. |
| 5,486,002 | A | 1/1996 | Witler et al. |
| 5,803,823 | A | 9/1998 | Gobush et al. |
| 6,086,487 | A | 7/2000 | Morgan et al. |
| 6,192,323 | B1 | 2/2001 | Boehm |
| 6,241,622 | B1 | 6/2001 | Gobush et al. |
| 6,385,559 | B2 | 5/2002 | Boehm |

(Continued)

FOREIGN PATENT DOCUMENTS

| | | |
|---|---|---|
| WO | 0021014 | 4/2000 |
| WO | 0059587 | 10/2000 |
| WO | 0071212 | 11/2000 |

OTHER PUBLICATIONS

International Search Report and Written Opinion in PCT Application No. PCT/US2012/065791, mailed on Mar. 27, 2013.

*Primary Examiner* — Paul A. D'Agostino
*Assistant Examiner* — Ankit Doshi
(74) *Attorney, Agent, or Firm* — Honigman Miller Schwartz and Cohn LLP; Anna M. Budde; Jonathan P. O'Brien

(57) ABSTRACT

A method and apparatus for determining an angle of attack of a golf swing based on multiple ball hitting is disclosed. Multiple golf balls of different known constructions are hit by a golfer. Club head speed and backspin data associated with each of the hit golf balls is measured. Based on a correlation between an angle of attack and measured data associated with the golf balls of different known constructions, an angle of attack of a golf swing can be determined. Different sets of golf balls of known constructions can be provided based on characteristics of a golfer. A kit including at least three golf balls of different known constructions and a database containing the correlation between data associated with the at least three golf balls and an angle of attack is also disclosed.

18 Claims, 12 Drawing Sheets

(56) References Cited

U.S. PATENT DOCUMENTS

| | | | | |
|---|---|---|---|---|
| 6,431,990 | B1 | 8/2002 | Manwaring | |
| 6,490,542 | B2 | 12/2002 | Boehm | |
| 6,561,917 | B2 | 5/2003 | Manwaring | |
| 6,611,792 | B2 | 8/2003 | Boehm | |
| 6,658,371 | B2 | 12/2003 | Boehm et al. | |
| 6,672,978 | B1 | 1/2004 | Morgan et al. | |
| 6,742,385 | B2 | 6/2004 | Katayama | |
| 6,758,759 | B2 | 7/2004 | Gobush et al. | |
| 6,760,685 | B2 | 7/2004 | Boehm | |
| 7,048,651 | B2 | 5/2006 | Kennedy, III et al. | |
| 7,143,639 | B2 | 12/2006 | Gobush | |
| 7,273,427 | B2 | 9/2007 | Inoue et al. | |
| 7,395,696 | B2 | 7/2008 | Bissonnette et al. | |
| 7,448,323 | B2 | 11/2008 | Kennedy, III et al. | |
| 7,503,858 | B2 | 3/2009 | Cameron | |
| 7,887,440 | B2 * | 2/2011 | Wright et al. | 473/409 |
| 7,959,517 | B2 * | 6/2011 | Lastowka | 473/198 |
| 2002/0098898 | A1 | 7/2002 | Manwaring | |
| 2002/0155896 | A1 | 10/2002 | Gobush et al. | |
| 2004/0006442 | A1 * | 1/2004 | Boehm | 702/145 |
| 2004/0127304 | A1 * | 7/2004 | Plank, Jr. | 473/221 |
| 2005/0268705 | A1 * | 12/2005 | Gobush | 73/65.03 |
| 2007/0105637 | A1 | 5/2007 | Shimizu | |
| 2007/0244667 | A1 | 10/2007 | Ligotti, III et al. | |
| 2008/0020867 | A1 | 1/2008 | Manwaring | |
| 2008/0287207 | A1 | 11/2008 | Manwaring | |
| 2010/0151956 | A1 * | 6/2010 | Swartz et al. | 473/199 |
| 2011/0009215 | A1 | 1/2011 | Ichikawa et al. | |
| 2011/0177890 | A1 | 7/2011 | Tutmark | |
| 2011/0224007 | A1 | 9/2011 | Molinari | |

* cited by examiner

METHOD AND APPARATUS FOR DETERMINING AN ANGLE OF ATTACK FROM MULTIPLE BALL HITTING

BACKGROUND

The present invention relates to a system and method of determining an angle of attack of a golfer's swing, and in particular to a system and method of determining an angle of attack of a golfer's swing from multiple ball hitting.

Increased awareness and proliferation of golf equipment designed for particular levels of play has led to advances in matching a golfer with an appropriate golf club. Similarly, with advances in golf ball design, there has been increased interest in matching a golfer with an appropriate golf ball.

Golf club fitting has become well known and a routine service of golf pro shops. Typically, a combination of information about a golfer's physical characteristics, such as height, arm length, gender and age, and a golfer's swing characteristics, such as club head speed and angle of attack, are used to determine an appropriate club for a golfer.

Golf ball fitting is a newer process and generally uses a combination of subjective data gathered from a golfer questionnaire and objective swing characteristics, such as measurements of club head speed, ball speed, launch angle, angle of attack, backspin, side spin and total distance.

Thus, in both golf club fitting and golf ball fitting, there is a need in the art for a method and system for determining an angle of attack of a golfer's swing. Specifically, a method and system that will allow a golfer to conveniently and easily determine an angle of attack of the golfer's swing that can be useful for both golf club fitting systems and golf ball fitting systems.

SUMMARY

A method of determining an angle of attack of a golfer's swing from multiple ball hitting is disclosed. In one aspect, the invention provides a method for determining an angle of attack of a golf swing, comprising: providing a set of golf balls, where each golf ball in the set has a unique, known construction; measuring at least a first parameter associated with a first ball selected from the set when the first golf ball has been hit by a golf club; measuring at least a first parameter associated with each of the remaining golf balls in the set when each of the remaining golf balls have been hit by a golf club; and determining an angle of attack of a golf swing by correlating the measured parameters associated with each of the golf balls in the set to the angle of attack.

In another aspect, the invention provides a system for determining an angle of attack of a golf swing of a golfer, the system comprising: a set of golf balls, where each golf ball in the set has a unique, known construction; a monitoring apparatus for measuring parameters associated with the set of golf balls when each golf ball in the set has been hit by a golf club; and a processor for determining an angle of attack of a golf swing by correlating the measured parameters associated with each of the golf balls in the set to the angle of attack.

In another aspect, the invention provides a kit for determining an angle of attack of a golf swing of a golfer comprising a set of golf balls, where each golf ball in the set has a unique, known construction such that the angle of attack can be correlated using measured parameters associated with each of the golf balls in the set when hit by the golfer.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
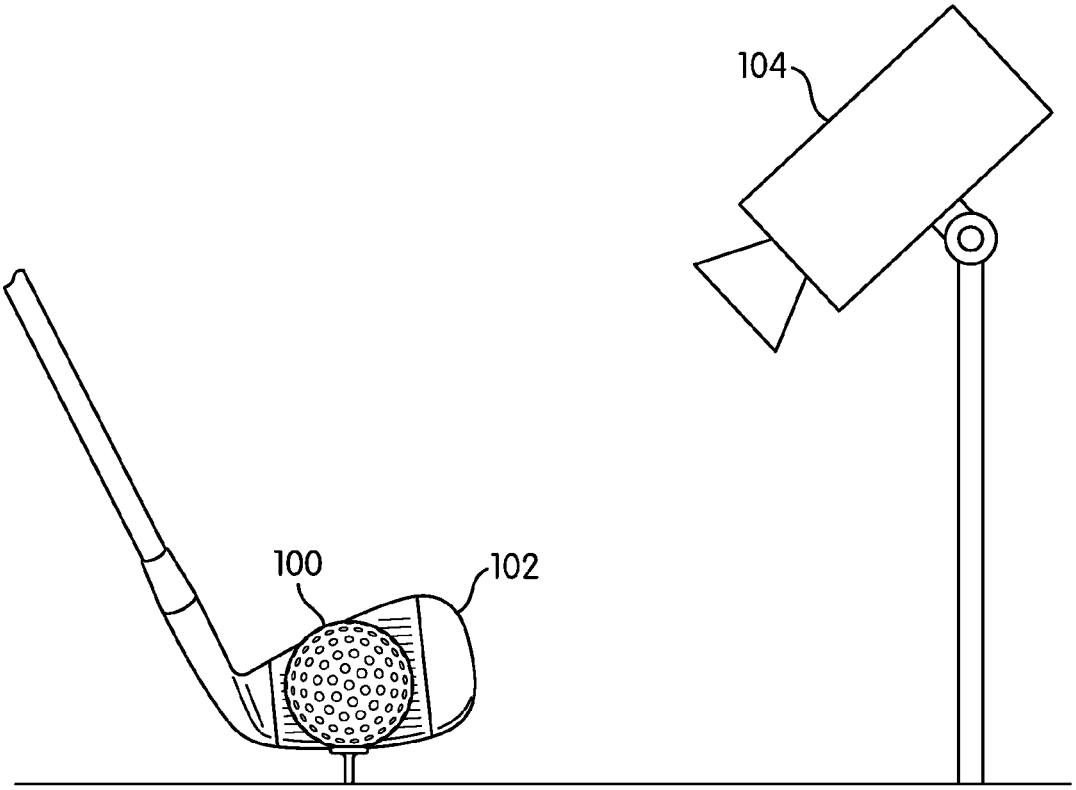
FIG. 1 is an isometric view of an exemplary embodiment of an apparatus for determining an angle of attack of a golf swing.

One element that determines the ball flight path and other characteristics associated with hitting a golf ball is the position in the arc of the swing at which the golf club strikes the golf ball. This is known as the angle of attack. The angle of attack generally describes the swing plane of a golfer. A level swing or zero angle of attack is where impact is made at the very bottom of the swing arc.

A golfer may instead hit the ball at a slight angle. If a golfer hits a ball at a slight upward angle, i.e., while the club is moving toward the top of the swing arc, this is known as a positive angle of attack. If a golfer hits a ball at a slight downward angle, i.e., while the club is still moving toward the bottom of the swing arc, this is known as a negative angle of attack. In some cases, a negative angle of attack may be desired for a golf shot. This can be true when an iron is used to strike the ball. A negative angle of attack produces a larger degree of backspin than a ball hit at an upward angle or a zero angle. This may produce greater control for a golfer hitting into a green.

A golfer will typically hit a driver, on the other hand, at a low or even zero angle of attack. Since balls hit with a driver are usually being hit for distance into a fairway, relatively low spin is typically desirable. A ball with low backspin tends to flatten when flying, and, therefore, stays true to the flight path. Low backspin can allow a drive to fly further. Additionally, a ball with low backspin can roll further after contact with the ground, which is frequently desirable on drives, particularly for less experienced golfers.

Generally, an angle of attack of a golfer's swing can have a direct influence on a golfer's performance. A "flatter" swing will generally improve both distance and accuracy with a driver. A shallow angle of attack, i.e., a swing with angle of attack close to zero, results in a more solidly hit ball with less spin producing a longer and straighter shot. Divots are one way golfers typically review their angles of attack when hitting with their irons, since a golfer who hits with a shallow angle of attack will generally leave shallow divots while a golfer who hits with a steeper angle of attack, i.e., a swing with a large negative angle of attack, will generally leave deeper divots. Proficient players, such as Tour players, will generally have a shallow angle of attack, and higher handicap players will generally have a steeper angle of attack. Golf balls can be designed to help compensate for these swing mechanics associated with an angle of attack.

Knowing a golfer's angle of attack can assist in selecting an appropriate ball. This data can assist in selecting a ball that will produce a desired response when struck with different clubs. The present method and system can be used as a component in the system disclosed in copending and commonly owned U.S. Pat. No. 8,758,169, entitled "Method and System for Golf Ball Fitting Analysis", and filed on Jul. 7, 2009, which is incorporated herein by reference.

FIG. 1 is a view of an exemplary embodiment of an apparatus that is configured to determine an angle of attack of a golf swing. Referring to FIG. 1, an angle of attack may be determined using a launch monitor 104 to measure parameters associated with a golf ball 100 hit by a golf club 102. In this embodiment, launch monitor 104 includes a video camera to measure the parameters associated with golf ball 100 hit by golf club 102. In some embodiments, launch monitor may include multiple cameras to measure parameters associated with a golf ball and a golf club. In some cases, the launch monitor may include one or more CCD cameras. In other cases, launch monitor may also include a radar swing speed detector, a motion capture device, or any number of such devices. Various other optical, photographic, infrared, ferromagnetic or laser sensors or measuring devices are all contemplated to be used to measure the parameters associated with a golf ball hit by a golf club.

Figure 2:
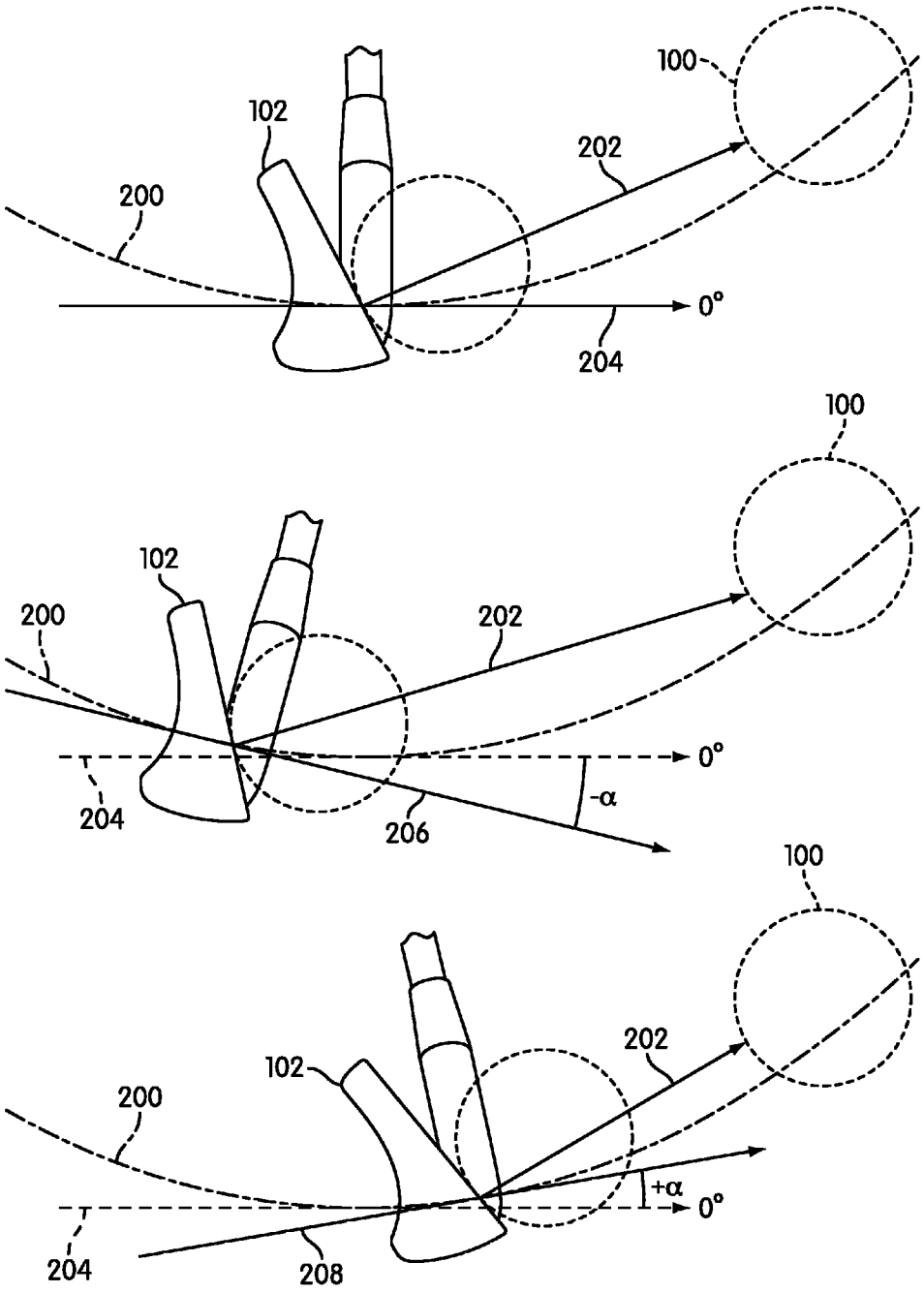
FIG. 2 is an isometric view of an illustration of a golf swing with a zero angle of attack, a golf swing with a negative angle of attack and a golf swing with a positive angle of attack.

FIG. 2 illustrates three exemplary views of an angle of attack of a golfer's swing. As illustrated in the three views, golf club head 102 travels toward golf ball 100 in path 200. At the point of contact, golf ball 100 travels along ball flight path 202. Generally, the angle of attack a represents the angle of the club head's path as it travels toward, and then makes contact with, the golf ball. The angle of attack is determined by the golfer's swing mechanics. As a reference point, most golf instruction refers to a zero angle of attack as meaning that the club head is traveling level with the ground at impact. This is sometimes called a sweeping angle of attack. FIG. 2 illustrates a zero angle of attack 204.

A golfer's swing can also produce a negative angle of attack. As illustrated in FIG. 2, the golf club head 102 comes down at golf ball 100 along path 200 and moves below the golf ball after impact, creating a negative angle of attack 206. A golfer's swing can also produce a positive angle of attack. As illustrated in FIG. 2, the golf club head 102 travels below golf ball 100 along path 200 and moves up through impact, creating a positive angle of attack 208.

When a golf ball is hit by a golf club, the force of the impact deforms the golf ball. In the process, the kinetic energy of the golf club is transferred to the golf ball through the impact. The amount of energy transferred from the golf club to the golf ball is represented by the coefficient of restitution (COR). The COR is expressed as a number between 0 and 1, where 0 represents an inelastic impact where all the energy of the impact is absorbed and 1 represents an elastic impact where all the energy of the impact is transferred.

Golf balls can have known construction and response properties, including, but not limited to coefficient of restitution (COR), construction type, compression, dimple pattern, tendency to spin, and other properties. These properties can be different depending on the composition and configuration of the golf ball.

Golf balls can be made in various configurations and can be composed of a variety of materials. Golf balls configurations may include, but are not limited to two piece, three piece or four piece configurations. Each configuration includes a cover. In some cases, the cover material may include, but is not limited to urethane, balata, synthetic balata, Surlyn®, elastomer and other materials. The inner composition of a golf ball may include a core, a mantle and additional core or mantle layers, depending on whether the golf ball is a two piece, three piece or four piece configuration. The inner composition of a golf ball may include a variety of materials including, but not limited to: natural rubber, balata, synthetic rubber, plastics, thermoplastics, polymers, elastomers, resins and other materials and combinations of materials.

Figure 3:
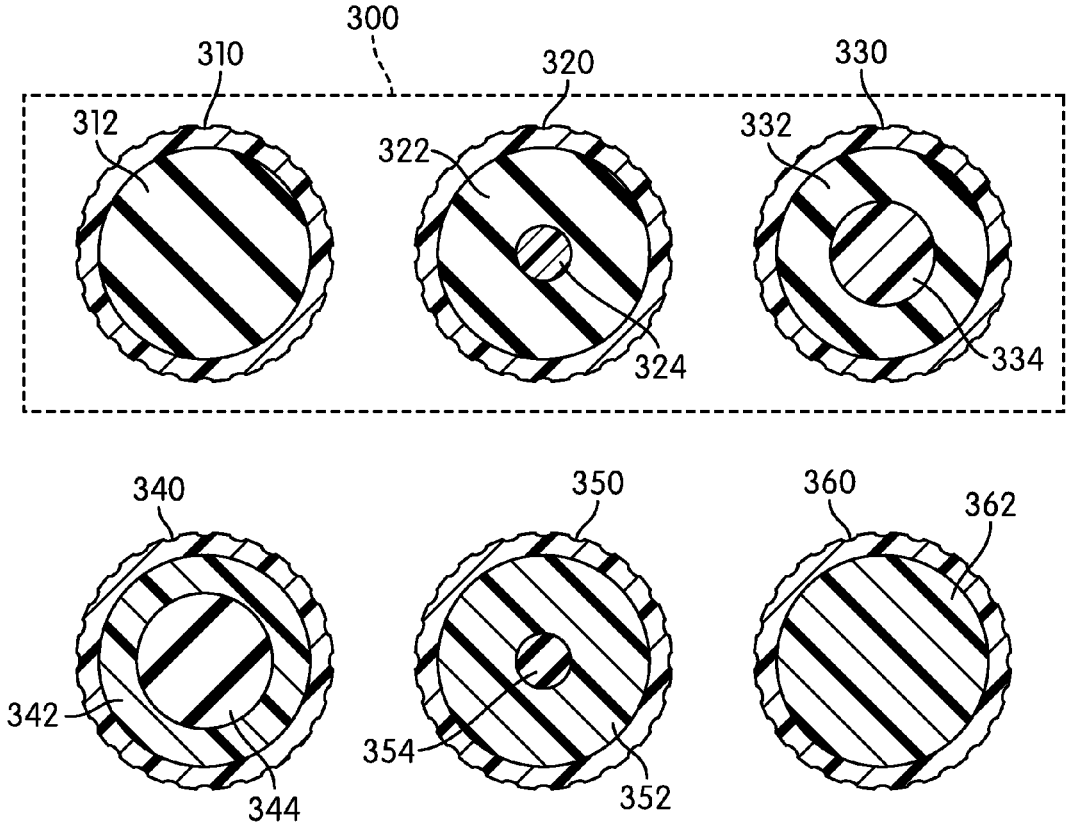
FIG. 3 is an isometric view of an exemplary embodiment of golf balls of different known constructions.

According to one exemplary embodiment illustrated in FIG. 3, a number of golf balls with different known constructions are provided. Referring to FIG. 3, a two piece golf ball 310 is illustrated with a synthetic cover material and a rubber core 312, a three piece golf ball 320 is illustrated with a synthetic cover material, a polymer core 324 and a rubber mantle 322, and a three piece golf ball 330 is illustrated with a synthetic cover material, a larger polymer core 334 and a rubber mantle 332.

Also referring to FIG. 3, a three piece golf ball 340 is illustrated with a synthetic cover material, a rubber core 344 and a polymer mantle 342, a three piece golf ball 350 is illustrated with a synthetic cover material, a smaller rubber core 354 and a polymer mantle 354, and a two piece golf ball 360 is illustrated with a synthetic cover material and a polymer core 362. In this embodiment, a set 300 of golf balls with known constructions is shown. In other embodiments, golf balls of known constructions may be composed of different materials and in different configurations than those illustrated in FIG. 3.

Given a golf ball of known construction and response properties, a correlation can be made between the response properties and an angle of attack of a golf swing. In some cases, this correlation can be generated by using a golf swing robot to hit each of the golf balls of known construction multiple times and with various angles of attack and gather measured data associated with the hit golf balls. Golf swing robots are well-known in the art, and any type of robot capable of consistently swinging a golf club according to a programmed set of instructions may be used. In some embodiments, the result can include a database containing data associated with each of the golf balls with different known constructions and response properties correlated to the angle of attack. In other cases, analytic software may be used to execute a program that can correlate the measured data associated with the golf balls of different known constructions to an angle of attack.

Figure 4:
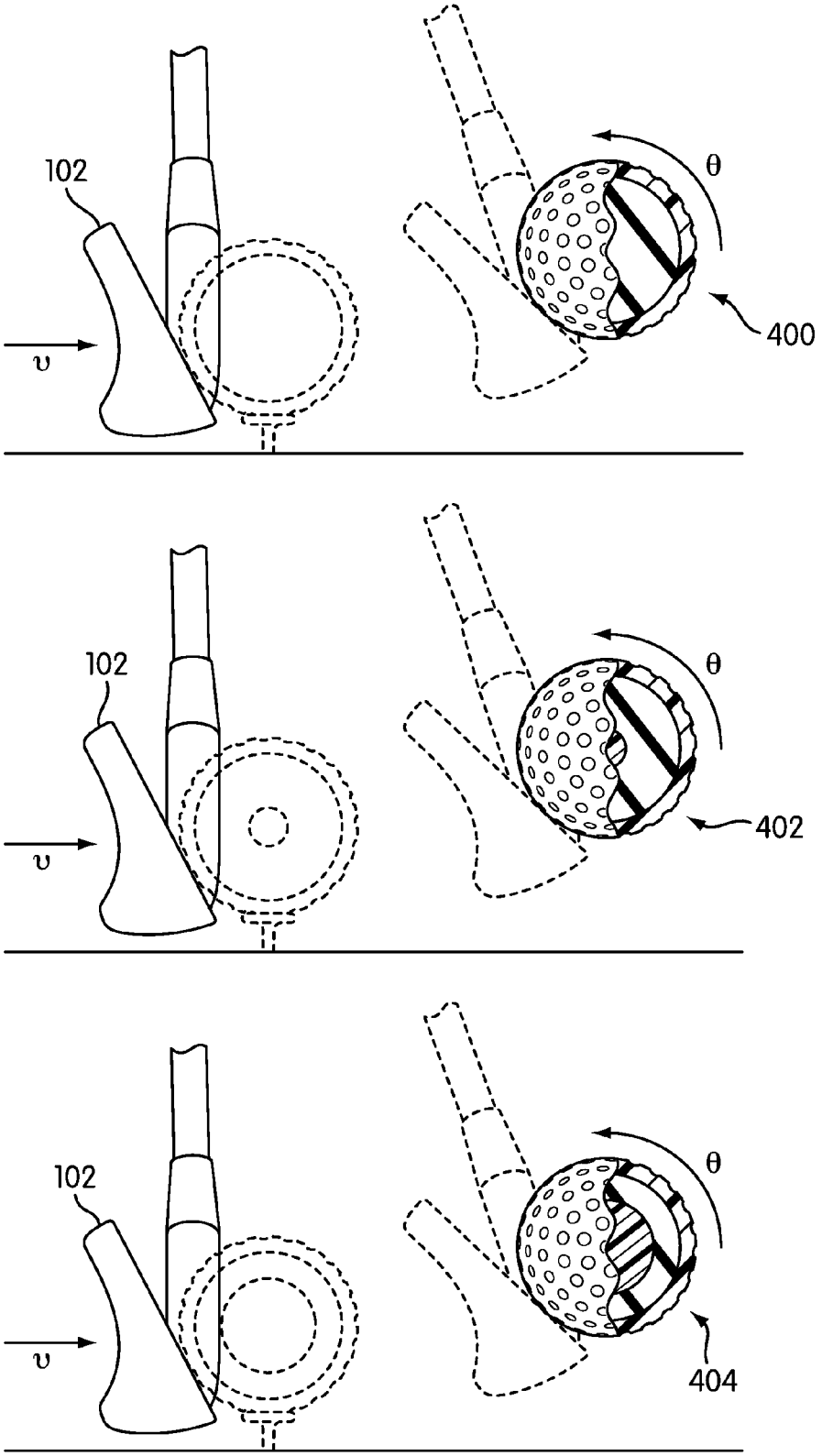
FIG. 4 is an isometric view of an exemplary embodiment of a golfer hitting three golf balls of different known constructions.

An angle of attack of a golfer's swing may be determined using measured parameters associated with a golf ball of known construction hit by a golf club. FIG. 4 illustrates an exemplary embodiment of a golf club 102 hitting a first golf ball 400, a second golf ball 402 and a third golf ball 404, each golf ball with different known constructions. As shown in FIG. 4, for each golf ball of known construction, the club head speed v of the golf club 102 and the backspin θ of the golf ball after the golfer (not shown) strikes the golf ball with the golf club 102 are measured. In this embodiment, the measured parameters include club head speed and backspin. In other embodiments, other parameters may be measured. Measured parameters may include, but are not limited to: club head speed, ball speed, launch angle, angle of attack, backspin, side spin, total distance and other parameters associated with a golf ball or a golf club. No specific device or method of measuring the parameters associated with the golf balls is essential. Many devices and systems for measuring parameters, including club head speed and backspin, are well-known in the art, and any of these devices and systems can be used in the present system. For example, any standard launch monitor may be used.

Figure 5:
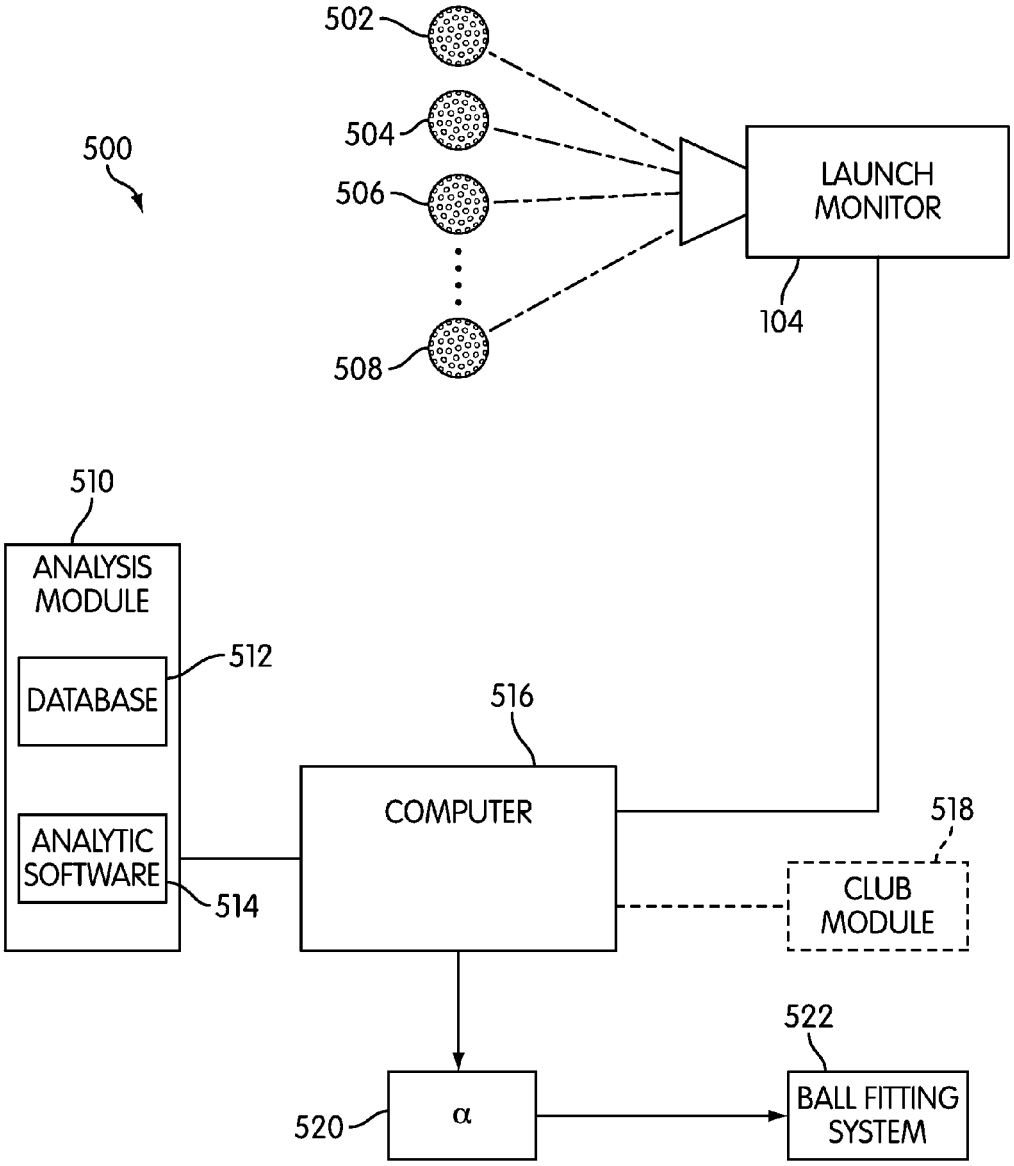
FIG. 5 is an isometric view of an embodiment of a system for determining an angle of attack of a golf swing.

FIG. 5 illustrates an exemplary embodiment of a system for determining an angle of attack of a golf swing from multiple ball hitting. System 500 can include a launch monitor 104 for measuring parameters associated with multiple golf balls with different known constructions, including a first golf ball 502, a second golf ball 504, a third golf ball 506, and a last golf ball 508 when hit by a golf club. System 500 also can include a computer 516 for receiving measured parameters associated with first golf ball 502, second golf ball 504, third golf ball 506, and last golf ball 508 from launch monitor 104. In some embodiments, computer 516 also may receive data associated with a golf club from club module 518. Computer 516 may be provided in various hardware and software configurations, including, but not limited to: a processor, a smart phone or other portable device including a processor, a terminal connected to a server over a network, and other hardware or software configurations for processing data.

In one embodiment, computer 516 may communicate with an analysis module 510 for correlating the measured parameters received from launch monitor 104 to an angle of attack. In some embodiments, analysis module may be included in the computer 516. In other embodiments, analysis module may be connected to the computer 516 in various ways, including, but not limited to: a wire, a physical connector, a wired network, a wireless network or other wired or wireless communication methods. Analysis module 516 may include, but is not limited to: a processor, a computer, a server, a smart phone or other portable device including a processor, a terminal connected to a server over a network, and other hardware or software configurations for processing data.

Referring to FIG. 5, in this exemplary embodiment, analysis module 510 can include a database 512 and analytic software 514 used to determine the angle of attack. Analysis module 510 can receive the measured parameters from first golf ball 502, second golf ball 504, third golf ball 506, and last golf ball 508 from computer 516. In some cases, analysis module 510 may also receive data associated with a golf club received by computer 516 from club module 518. Analysis module 510 may include a processor configured to access database 512, execute analytic software 514, either or both, to determine the angle of attack from the received information. Analysis module 510 can transmit the determined angle of attack to computer 516 for output 520. In one exemplary embodiment, the angle of attack is output for use in a ball fitting system 522. In other embodiments, the angle of attack may be used for other applications, including a golf club fitting system and a golfer profile database.

Figure 6:
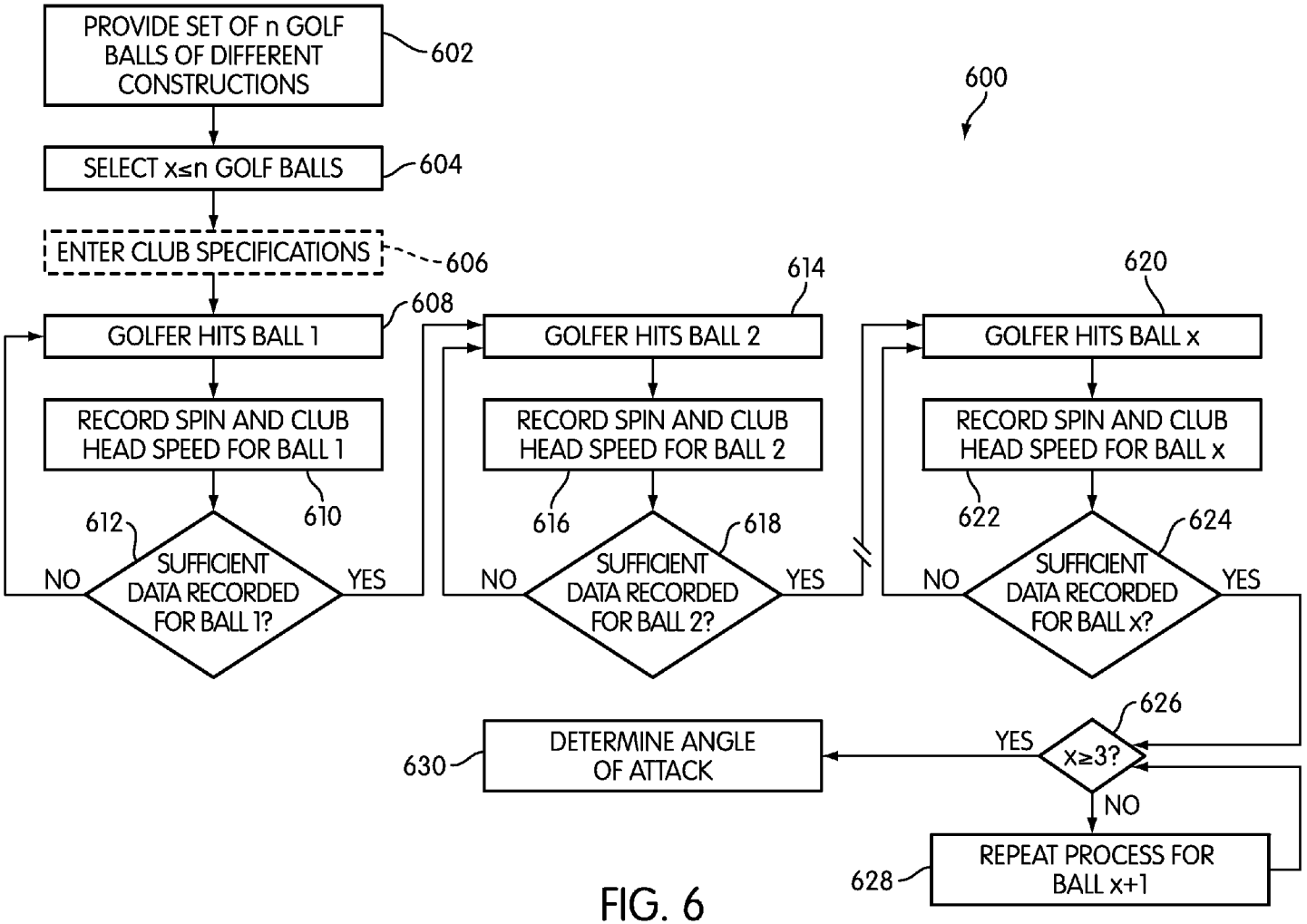
FIG. 6 is a flowchart of an exemplary embodiment of a method for determining an angle of attack of a golf swing.

FIG. 6 illustrates a flowchart of an exemplary embodiment of a method 600 of determining an angle of attack from multiple golf ball hitting. The order of the steps illustrated in FIG. 6 is exemplary and not required. Referring to FIG. 6, in a first step 602, according to this embodiment a set of n golf balls of different known constructions are provided. From the set of n golf balls, a subset of $x \leq n$ golf balls with different known constructions are selected in a second step 604 for a golfer to hit. In some embodiments, the choice of golf balls selected may be entered into the system to allow the known characteristics associated with the selected golf balls to be retrieved.

In some cases, criteria may be provided to allow subset x of golf balls with different known constructions to be selected for a particular golfer. In some embodiments, the criteria may include a characteristic of the golfer. Characteristics of the golfer that may be used to determine the criteria include, but are not limited to: age, gender, skill level, handicap, data from a golfer profile database, answers from a questionnaire, swing characteristics and other characteristics of a golfer.

In some embodiments, the criteria for selecting a subset of golf balls with different known constructions for a particular golfer may be provided in a guide. In other embodiments, the criteria can be shown on a display. In other embodiments, the criteria may be input into a computer. Still other embodiments of criteria for selecting the subset of golf balls may be possible, including selecting a random subset of golf balls, selecting golf balls closely matching a golfer's preferred golf ball and other objective or subjective criteria.

Referring to FIG. 6, in some embodiments specifications of a golf club being used to hit the golf balls can be entered in optional third step 606. Golf club 102 may be any type of club known in the art. In some embodiments, the golfer may be asked to hit with a test club, which may be a driver, an iron, or any type of club. In other embodiments, golf club 102 may be the golfer's own club. The golf club 102 may be a club of known specifications, including having a known coefficient of friction of the club face and other known properties.

After the selected ball and, optionally, the club specifications have been inputted to the system, according to the exemplary embodiment illustrated in FIG. 6, in a fourth step 608 a golfer (not shown) hits a first ball of known construction. At least spin rate and club head speed associated with the first hit ball can be recorded in fifth step 610. In sixth step 612, the system determines whether sufficient data associated with the first golf ball has been recorded. If there is not sufficient data, the golfer returns to fourth step 608 to again hit the first golf ball. In some cases, data may not be sufficient if the parameters associated with the golf ball have not been measured or have not been recorded within acceptable tolerances. In other cases, data may not be sufficient if the method requires more than a single impact per golf ball for determining the angle of attack. Other reasons for determining that the data is not sufficient are also possible, such as if the golfer is unhappy with the feel of his or her shot.

As illustrated in FIG. 6, if there is sufficient data, the system moves to step 614 where the golfer hits a second golf ball of a different known construction. In step 616, at least spin rate and club head speed associated with the second hit ball can be recorded. As described above with regard to the first ball, if there is not sufficient data recorded for the second ball, the golfer returns to step 614 to again hit the second ball. If there is sufficient data, the golfer proceeds to hit the next golf ball of a different known construction. The process can continue until a golfer hits golf ball x of different known construction in a ninth step 620. At least spin rate and club head speed associated with hit ball x can be recorded in a tenth step 622. At an eleventh step 624, the system determines if there is sufficient data recorded of ball x. If there is not sufficient data recorded for ball x, the method returns to ninth step 620 and the golfer again hits ball x. If there is sufficient data, twelfth step 626 provides a check to make sure at least x≥3 golf balls with different known constructions have been hit. In this exemplary embodiment, at least three golf balls of different known constructions may be hit by a golfer. In other embodiments, more or fewer golf balls with different known constructions may be hit by a golfer.

Referring to FIG. 6, in this embodiment, if at least the minimum number of golf balls with different known constructions have not been hit, the method returns to the process described in ninth step 620, tenth step 622, and eleventh step 624 for ball x+1 in thirteenth step 628. If the minimum number of golf balls has been met, the angle of attack for the golfer is determined using the recorded data associated with the hit golf balls in final step 630.

Figure 7:
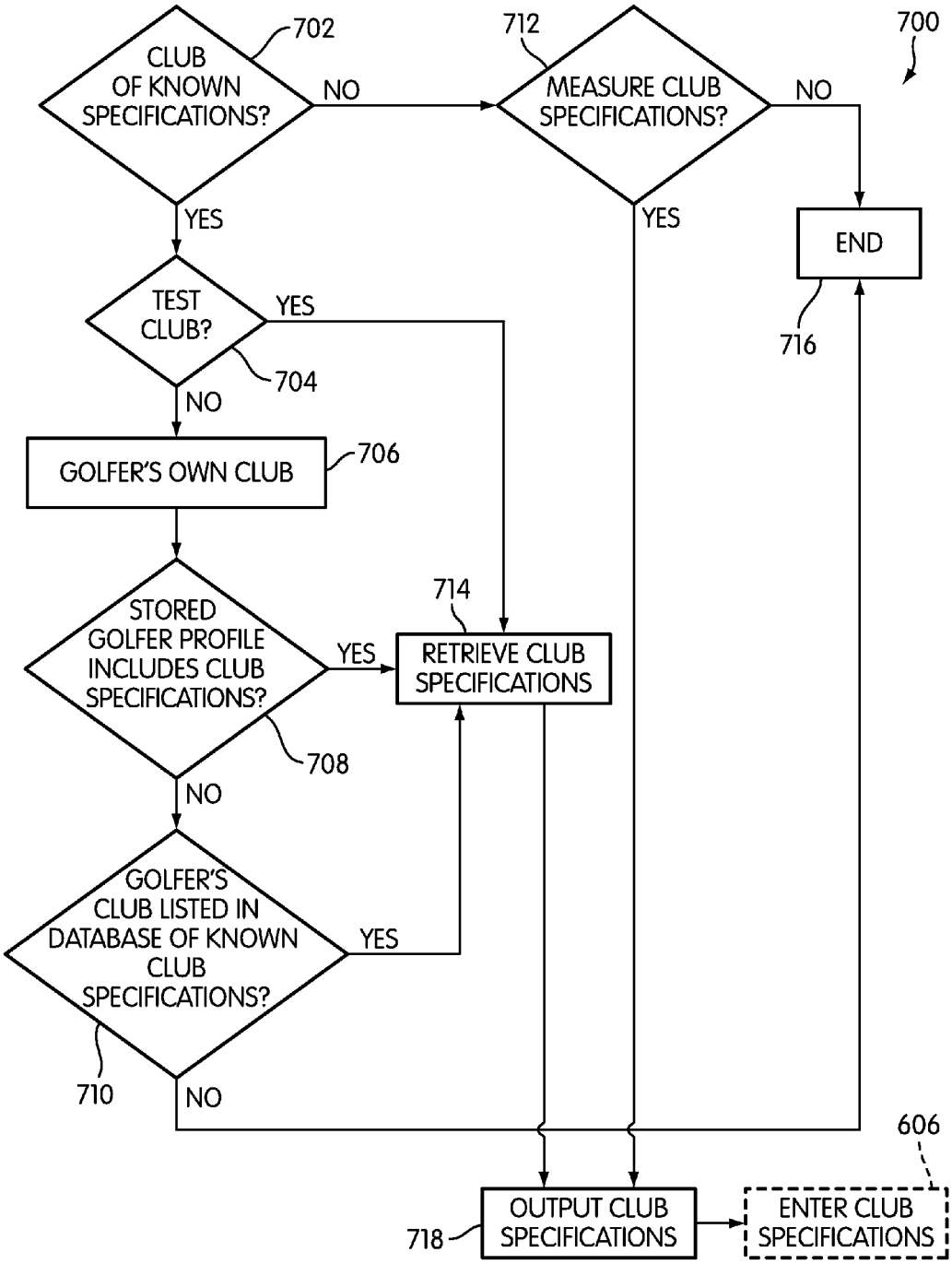
FIG. 7 is a flowchart of an exemplary embodiment of a method for entering known golf club specifications.

FIG. 7 illustrates an exemplary embodiment of a method 700 of determining club specifications of a golf club. The order of the steps illustrated in FIG. 7 is exemplary and not required. As described above, a golf club used for hitting multiple golf balls of different known constructions may be any type of club known in the art. At first step 702, the system determines whether the club is of known specifications. If the club is of known specifications, the process moves to a second step 704 to determine whether the club is a test club. In some cases, a test club of known specifications may be provided on the premises where the ball hitting apparatus is located.

If the club is not a test club, the process can determine that the golf club is the golfer's own club at third step 706 and can proceed to check whether there exists a stored golfer profile that includes club specifications at fourth step 708. If there is no stored golfer profile, or the profile does not contain club specifications, the process can move to a fifth step 710 to check whether the golfer's club is listed in a database of known club specifications. In some cases, the database may be populated with club specifications of a variety of different golf clubs used by golfers. In other cases, the database may be capable of querying another database or website over the Internet.

In the exemplary embodiment illustrated in FIG. 7, if the process determines that club specifications are available at any of second step 704, fourth step 708, or fifth step 710, the club specifications are retrieved at a sixth step 714. Referring back to first step 702, if the club is not of known specifications, at step 712 the method can check whether the club specifications can be measured. In some cases, specifications of a golf club can be measured using other test equipment that may be located on the premises. Test equipment for measuring specifications of a golf club is well known in the art. The measured club specifications from step 712 or the retrieved club specifications from step 714 can be output at step 718. The output club specifications from step 718 may be entered at step 606 into a process 600 for determining an angle of attack. If club specifications are not available at step 710 or 712, the process ends at step 716.

Figure 8:
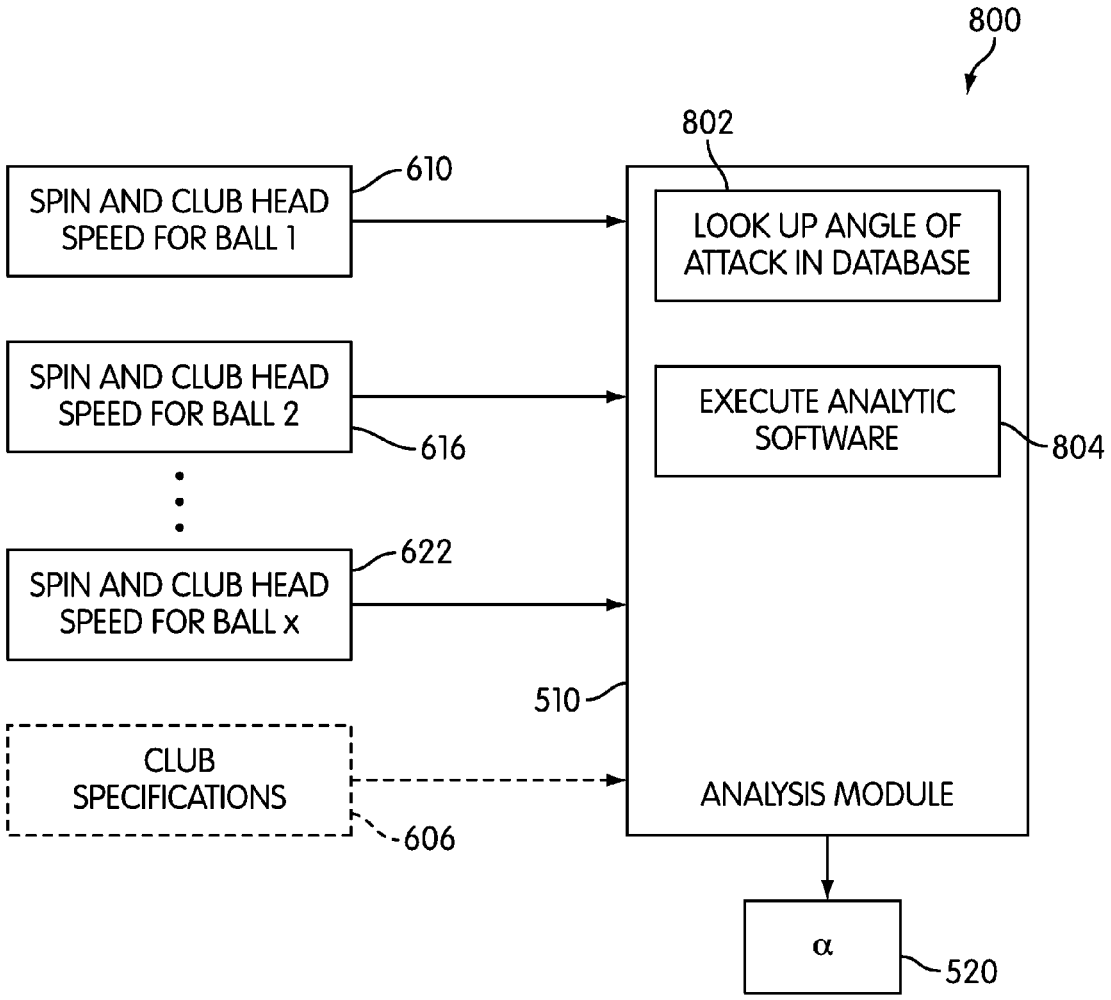
FIG. 8 is a flowchart of an exemplary embodiment of an analysis module determining an angle of attack of a golf swing.

FIG. 8 illustrates an exemplary embodiment of a method 800 for an analysis module 510 to determine an angle of attack 520. Analysis module 510 may be configured to determine an angle of attack 520. Analysis module 510 may receive first measured parameter(s) 610 associated with a first golf ball of known construction, second measured parameter(s) 616 associated with a second golf ball of known construction, and third measured parameter(s) 622 associated with a third golf ball of known construction. In one embodiment, analysis module 510 receives measured parameters associated with at least x number of golf balls with different known constructions. In an exemplary embodiment, x is at least three. In other embodiments, measured parameters associated with more or fewer golf balls with different known constructions may be provided to analysis module 510.

In the exemplary embodiment shown in FIG. 8, the first measured parameter(s) 610, the second measured parameter(s) 616, and third measured parameter(s) 622 can include spin rate and club head speed. The spin of a golf ball is the rotation of a golf ball while in flight. Spin includes rotation against the direction of flight, i.e., backspin, and rotation sideways to the direction of spin, i.e., side spin. The spin rate of a golf ball is the speed that the golf ball rotates on its axis while in flight. Typically, the spin rate is measured in revolutions per minute (rpm). Club head speed is a measurement of the velocity of the club head of a golf club at the bottom of a swing. In other embodiments, the measured parameters may include any parameters associated with a golf ball as described above. In some embodiments, analysis module 510 also may optionally receive club specifications 606 of a golf club.

Referring to FIG. 8, analysis module 510 receives the first measured parameter(s) 610, the second measured parameter(s) 616, and third measured parameter(s) 622. In some embodiments, at step 802 analysis module may look up a correlation with the measured parameters to an angle of attack in a database. In other embodiments, analytic module 510 may include a processor to execute analytic software at step 804 to correlate the measured parameters to an angle of attack. In other embodiments, an analysis module may both access a database and execute analytic software to determine the angle of attack from the measured parameters. In some cases, analysis module 510 also may use data associated with club specifications 606 with the database or analytic software to determine the angle of attack.

Figure 9:
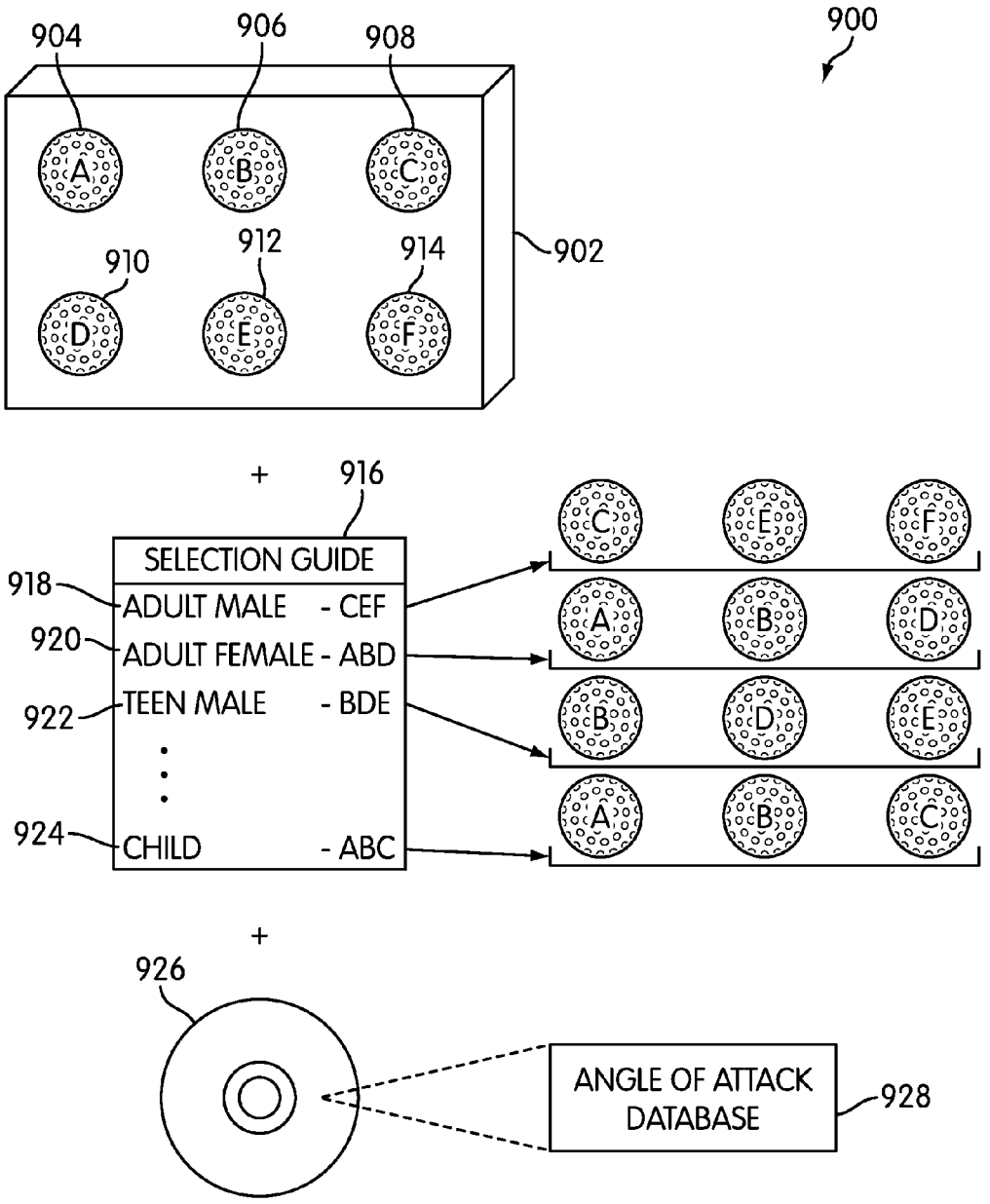
FIG. 9 is an isometric view of an embodiment of a kit for determining an angle of attack from multiple ball hitting.

FIG. 9 illustrates an exemplary embodiment of a kit 900 for determining an angle of attack of a golf swing of a golfer from multiple ball hitting. As illustrated in FIG. 9, kit 900 can include a set 902 of golf balls with unique, known constructions. Set 902 may include a first golf ball 904 of a first known construction, a second golf ball 906 of a second known construction, a third golf ball 908 of a third known construction, a fourth golf ball 910 of a fourth known construction, a fifth golf ball 912 of a fifth known construction, and a sixth golf ball 914 of a sixth known construction. Kit 900 may also include a selection guide 916 for selecting a subset of the set 902 of golf balls for a golfer to hit.

In the exemplary embodiment illustrated in FIG. 9, selection guide 916 can include criteria based on an age and a gender of a golfer. In other embodiments, selection criteria for determining a subset of golf balls with known constructions may include one or more different characteristics of a golfer as described above. In this exemplary embodiment, selection guide 916 can include a subset for an adult male 918 of golf balls with different known constructions. Similarly, selection guide can include other subsets of golf balls with different known constructions for an adult female 920, a teen male 922 and a child 924.

Referring to FIG. 9, in this embodiment, each subset may include different groups of golf balls with different known constructions. For example, selection guide 916 can list subset (CEF) for an adult male and subset (ABC) for a child 924. In some cases, the subset can be chosen based a likely preference for a particular type of golf ball. In other cases, subset categories may be chosen based on a variety of objective or subjective criteria more fully described above.

Kit 900 also may include a storage medium 926 containing an angle of attack database 928 correlated to the set of golf balls 902 included in the kit 900. In an exemplary embodiment, storage medium 926 containing angle of attack database 928 is a CD-ROM disc. In some embodiments, the storage medium may be any machine-readable media, including, but not limited to: flash memory, other types of media such as magnetic devices, optical devices or the like. In other embodiments, an angle of attack database may be provided in a chart or other printed format. In other embodiments, the database may include a code for allowing a user to access remotely stored data associated with the set of golf balls of different known constructions correlated to an angle of attack.

In various embodiments, the kit for determining an angle of attack of a golf swing from multiple ball hitting can be used by an operator. In some embodiments, the operator may be associated with a pro shop or other retail location. In some cases, the kit can be used in conjunction with existing equipment. In other cases, the kit may include additional equipment to allow the parameters associated with the golf balls of different known construction to be measured. In other embodiments, the operator may be a consumer. In some cases, the consumer may use the kit to determine an angle of attack of the consumer's golf swing.

In some embodiments, the kit may include a set of replacement golf balls of different known constructions. In some cases, the replacement golf balls of different known constructions may be a particular subset of golf balls of different known constructions. In some embodiments, the kit of replacement golf balls of different known constructions may include a replacement angle of attack database or a replacement selection guide or both. Various combinations for replacement kits are contemplated by different embodiments.

Figure 10:
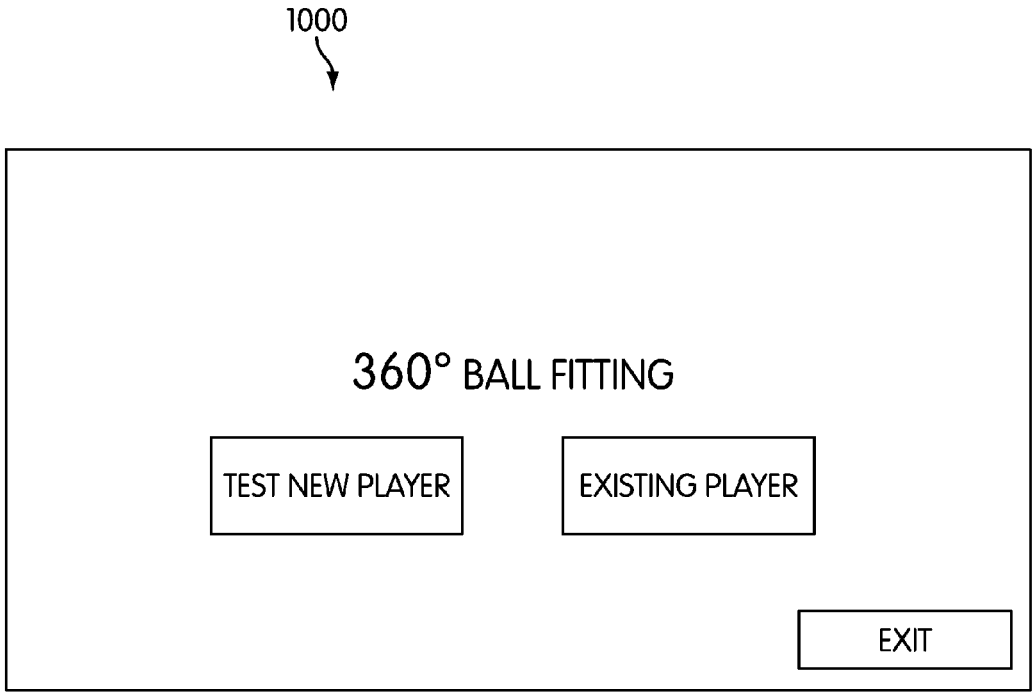
FIG. 10 is an isometric view of an embodiment of a ball fitting system interface.
Figure 11:
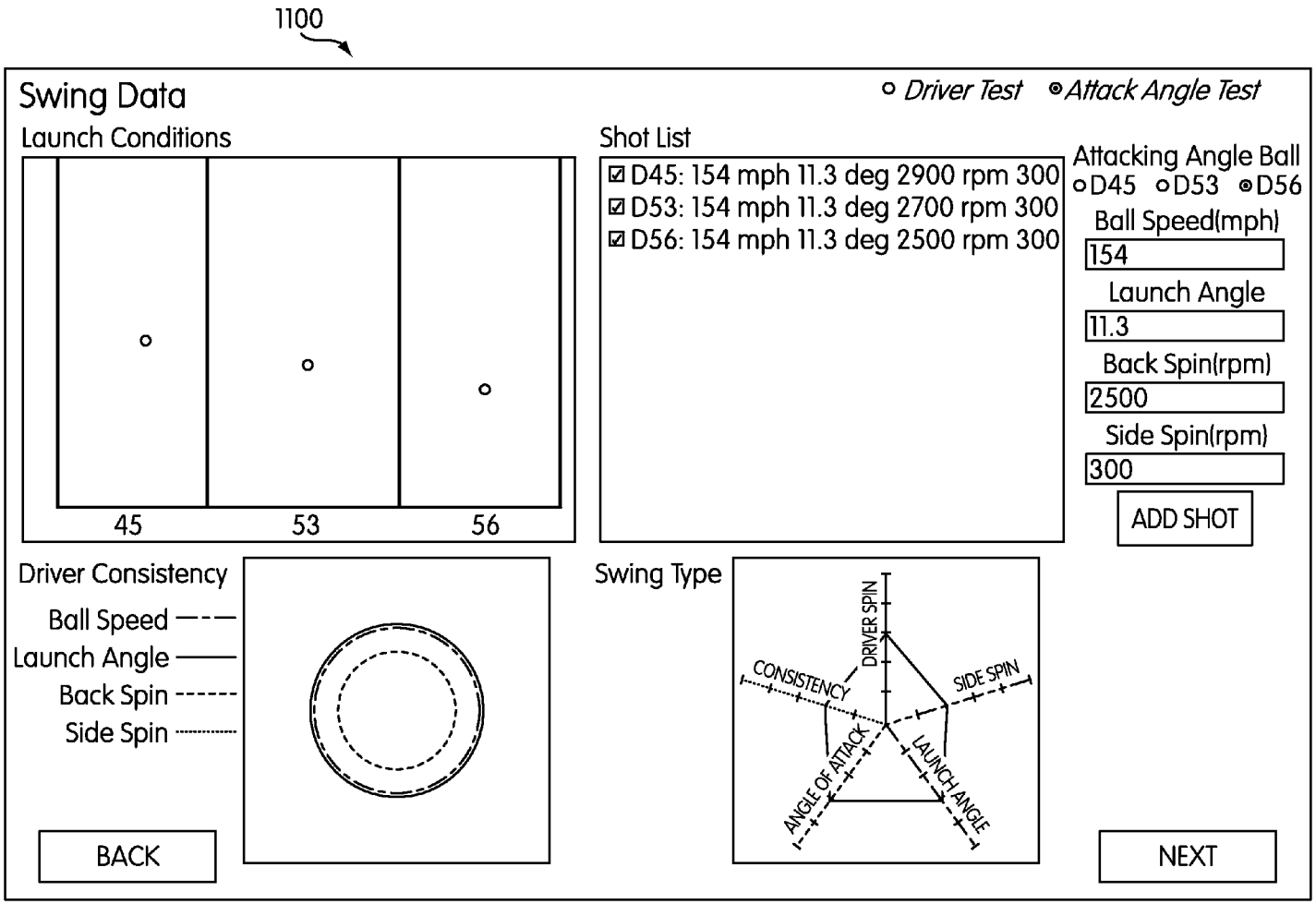
FIG. 11 is an isometric view of an embodiment of a ball fitting system interface for entering angle of attack data.

FIGS. 10 and 11 illustrate an exemplary embodiment of an angle of attack obtained from multiple ball hitting being used as part of a ball fitting system. In one embodiment, an angle of attack is used as a component in a ball fitting system disclosed in copending and commonly owned U.S. Pat. No. 8,758,169, entitled "Method and System for Golf Ball Fitting Analysis", and filed on Jul. 7, 2009, discussed and incorporated by reference above. FIG. 10 illustrates a sample entry screen 1000 in which an operator can choose between a new player or an existing player. In some cases, an existing player may have a profile stored in a database or on a removable media to allow the computer to retrieve the player information. FIG. 11 illustrates a sample screen shot 1100 of a computer displaying the results of obtained angle of attack data of a golfer. As shown in FIG. 11, the obtained angle of attack data may be graphically represented to the golfer to provide a visual depiction of the obtained data for golf balls of different known constructions.

Figure 12:
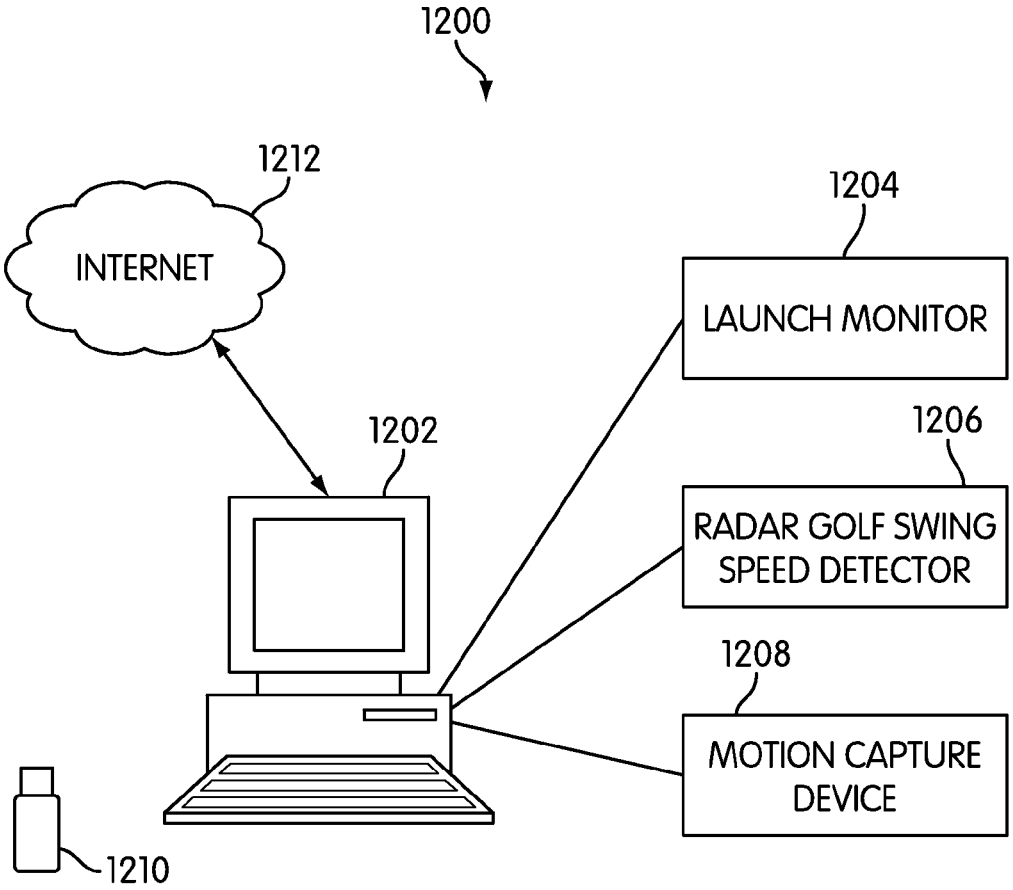
FIG. 12 is an isometric view of an embodiment of a ball fitting system.

FIG. 12 illustrates a schematic diagram of an exemplary embodiment of a system 1200 for performing the ball fitting method. The system 1200 can include a computer 1202 running software to collect the inputs and perform the calculations discussed herein. Computer 1202 may be functionally connected via hardwire or wirelessly, to various measurement equipment such as a launch monitor 1204, a radar swing speed detector 1206, a motion capture device 1208 or any number of such devices. In some cases, putting monitors could be used to capture the attack angle of the club and launch angle. Various other optical, photographic, infrared, ferro-magnetic or laser sensors or measuring devices are all contemplated to be used to collect the objective data of the golfer.

While the software for performing the method of ball fitting could be run on a standalone general purpose computer 1202, it is also contemplated that computer 1202 could be a server or connected to the Internet 1212. In some embodiments, computer 1202 may include, but is not limited to: a desktop computer, a portable computer, a server, a smart phone or other portable device including a processor, a terminal connected to a server over a network, and other hardware or software configurations for processing data. Computer 1202 could be a terminal to use the method of ball fitting online or remotely from where the software resides or is hosted. The computer 1202 may also include a keyboard, a mouse, and a monitor controlled by a display card. The computer 1202 also may include a hard disk or other fixed, high density media drive, and a removable media device drive into which a removable magneto-optical media such as a disk is inserted and read and/or written to. These discrete components are connected using an appropriate device bus. The computer 1202 may also be connected to a printer (not shown) to provide printed listings of any of the inputs, intermediate calculations, and outputs associated with a golfer, a golf ball or a golf club. Examples of computer readable media present in the system illustrated in FIG. 12 include the memory, the hard disk, and the removable media. Stored on any one or a combination of computer readable media, the described method and system includes software for controlling the hardware of the computer and for enabling the computer to interact with a user. The software may include, but is not limited to, device drivers, operating systems and user applications. Computer readable media further includes the computer program product for determining an angle of attack.

It is also contemplated that a removable media device such as flash memory 1210 could be used with computer 1202 to store a golfer's inputs and information. This would enable a golfer to reevaluate after some time has lapsed to determine how their game has changed over time. This would also enable a golfer to prepare to play in a different location with different altitude and climate by changing only those inputs to their stored data. This would also enable portability of their information in case of travel or relocation.

Although the removable memory is illustrated as flash memory, other types of media such as magnetic devices, optical devices, and the like are also within the scope of the invention.

It is also contemplated that the method of determining an angle of attack could be part of a broader athlete data storage, analysis and retrieval system in which vital statistics and game statistics are stored for review or analysis by various programs, and to recommend new equipment suited to an athlete's game. Such programs or data could be run on hand held devices as smart phones or other personal computing devices, with the possibility of sharing the data by users who have given each other authorization to view the data.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A method for determining an angle of attack of a person's golf swing, comprising:

providing a set of golf balls comprising at least two golf balls, where each golf ball in the set has a unique construction;

providing a computer with an analysis module that can access a lookup table having for each golf ball at least two parameters for a golf club swing hitting the golf ball at different known angles of attack;

having the person hit each golf ball in the set of golf balls with a golf club swing, measuring the at least two parameters for the person's hit of each golf ball in the set of golf balls with a launch monitor, and inputting to the computer the measured parameters for the person's hit of each of the golf balls in the set; and using the analysis module to correlate the measured parameters for the person with the at least two parameters in the lookup table for known angles of attack to indirectly determine an angle of attack for the person's golf swing.

2. The method of claim 1, wherein the at least two parameters comprise club head speed and ball spin rate.

3. The method of claim 1, wherein the set includes at least three golf balls.

4. The method of claim 1, wherein the step of providing a set of golf balls further includes selecting a subset of the set of golf balls for the golfer to hit.

5. The method of claim 4, wherein the step of selecting includes selecting the subset based on at least one of a gender, an age, and a profile of the golfer.

6. The method of claim 1, further comprising the step of determining whether sufficient data has been input to determine the angle of attack for the person's golf swing.

7. A system for determining an angle of attack of a golf swing of a golfer, the system comprising:

a set of golf balls comprising at least two golf balls, where each golf ball in the set has a unique construction and a plurality of known response parameters when hit at a known angle of attack;

a monitoring apparatus for measuring response parameters when each golf ball in the set is hit by a golf club; and a processor for receiving the measured response parameters wherein the processer includes an analysis module that is configured to indirectly determine an angle of attack of a golf swing by correlating the received measured response parameters associated with each of the golf balls in the set to known response parameters for each of the golf balls in the set when hit at a known angle of attack.

8. The system of claim 7, wherein the monitoring apparatus is adapted to measure at least club head speed and spin rate.

9. The system of claim 7, wherein the set includes at least three golf balls.

10. The system of claim 7, further including a guide that lists different subsets of the set of golf balls for the golfer to hit based on a characteristic of the golfer.

11. The system of claim 10, wherein the characteristic includes at least one of a gender, an age, and a profile.

12. The system of claim 7, wherein the analysis module includes at least one of:

a database including a lookup table that contains correlation data between the angle of attack and the measured parameters of the set of golf balls; and a program for determining the angle of attack based on measured parameters of the set of golf balls.

13. The system of claim 7, wherein the processor includes an indicator that sufficient data associated with each of the golf balls in the set has been received to determine the angle of attack.

14. The system of claim 13, wherein the indicator includes at least one of a message on a display, an auditory signal, and a visual signal.

15. A kit for determining an angle of attack of a golf swing of a golfer comprising:

a set of golf balls comprising at least two golf balls, where each golf ball in the set has a unique construction;

a database of at least two parameters for a golf club swing hitting the golf ball at different known angles of attack.

16. The kit of claim 15, further including a guide that lists different subsets of the set of golf balls for the golfer to hit based on a characteristic of the golfer.

17. The kit of claim 16, wherein the characteristic includes at least one of a gender, an age, and a profile.

18. The kit of claim 15, further including a computer readable storage medium containing executable instructions for accessing the database to correlate the data associated with the set of golf balls to the angle of attack and outputting the angle of attack.

* * * * *